US010706833B2

(12) United States Patent
Nohara et al.

(10) Patent No.: US 10,706,833 B2
(45) Date of Patent: Jul. 7, 2020

(54) ACTIVE NOISE CONTROL APPARATUS, ACTIVE NOISE CONTROL METHOD AND PROGRAM

(71) Applicant: PIONEER CORPORATION, Bunkyo-ku, Tokyo (JP)

(72) Inventors: Manabu Nohara, Saitama (JP); Akihiro Iseki, Saitama (JP)

(73) Assignee: PIONEER CORPORATION, Bunkyo-Ku, Tokyo (JP)

( * ) Notice: Subject to any disclaimer, the term of this patent is extended or adjusted under 35 U.S.C. 154(b) by 0 days.

(21) Appl. No.: 15/771,736

(22) PCT Filed: Oct. 30, 2015

(86) PCT No.: PCT/JP2015/080720
§ 371 (c)(1),
(2) Date: Apr. 27, 2018

(87) PCT Pub. No.: WO2017/072947
PCT Pub. Date: May 4, 2017

(65) Prior Publication Data
US 2018/0322858 A1 Nov. 8, 2018

(51) Int. Cl.
*G10K 11/178* (2006.01)

(52) U.S. Cl.
CPC ..... *G10K 11/178* (2013.01); *G10K 11/17853* (2018.01); *G10K 11/17875* (2018.01); *G10K 2210/1282* (2013.01); *G10K 2210/12821* (2013.01); *G10K 2210/3028* (2013.01); *G10K 2210/3044* (2013.01)

(58) Field of Classification Search
None
See application file for complete search history.

(56) References Cited

U.S. PATENT DOCUMENTS 5,729,605 A * 3/1998 Bobisuthi ..... H04R 1/1041 379/430
2001/0046301 A1 11/2001 Nakamura et al.
2006/0188107 A1* 8/2006 Inoue ..... G10K 11/178 381/71.4

(Continued)

FOREIGN PATENT DOCUMENTS

JP H09-288489 A 11/1997
JP 2001-333490 A 11/2001

(Continued)

OTHER PUBLICATIONS

International Search Report for related PCT Application No. PCT/JP2015/080720, dated Dec. 22,2015; English translation provided; 4 pages.

*Primary Examiner* — Kenny H Truong
(74) *Attorney, Agent, or Firm* — Procopio, Cory, Hargreaves & Savitch LLP

(57) ABSTRACT

The active noise control device detects noise, and delays a phase of a detected noise signal in a low frequency band. In a non-closed-type noise control device, since there occurs such a phenomenon that the phase of the noise signal advances in the low frequency band, the correction unit performs a correction to cancel the phase advance by delaying the phase. By outputting the noise reduction sound based on the phase-corrected noise signal, the noise is reduced.

14 Claims, 13 Drawing Sheets

(56) References Cited

U.S. PATENT DOCUMENTS

| | | | | |
|---|---|---|---|---|
| 2008/0188271 | A1* | 8/2008 | Miyauchi | G10L 21/0208 455/569.2 |
| 2010/0111317 | A1* | 5/2010 | Asao | B60R 13/0815 381/71.4 |
| 2010/0150367 | A1 | 6/2010 | Mizuno | |
| 2010/0226505 | A1* | 9/2010 | Kimura | G10K 11/178 381/71.6 |
| 2016/0372104 | A1* | 12/2016 | Nystrom | G10K 11/17857 |

FOREIGN PATENT DOCUMENTS

| | | | |
|---|---|---|---|
| JP | 2002-055684 | A | 2/2002 |
| JP | 2007-259246 | A | 10/2007 |
| JP | 2012-226366 | A | 11/2012 |

* cited by examiner

<CLOSED-TYPE>

<OPEN-TYPE (NON-CLOSED-TYPE )>

CHARACTERISTIC OF LOW BOOST FILTER

<SIMPLE OPEN-TYPE>

<NON-CLOSED-TYPE>

ACTIVE NOISE CONTROL APPARATUS, ACTIVE NOISE CONTROL METHOD AND PROGRAM

CROSS-REFERENCE TO RELATED APPLICATIONS

This application is a U.S. National Stage entry of PCT Application No: PCT/JP2015/080720 filed Oct. 30, 2015, the contents of which are incorporated herein by reference.

TECHNICAL FIELD

The present invention relates to an active noise control technique.

BACKGROUND TECHNIQUE

There is known an active noise control technique which cancels noise by sounds outputted by speakers. For example, Patent Reference-1 discloses an open-type vehicle interior noise reduction device which reduces noise in a vehicle interior by a feedforward type active noise control. Patent Reference-2 discloses a noise cancel device for a closed-type headphone which outputs a noise cancel signal from speakers by a feedback system to reduce noise level.

PRIOR ART REFERENCE

Patent Reference

Patent Reference-1: Japanese Patent Application Laid-open under No. H9-288489

Patent Reference-2: Japanese Patent Application Laid-open under No. 2007-259246

SUMMARY OF INVENTION

Problem to be Solved by the Invention

In a vehicle interior, it is required to reduce random noise such as road noise of a vehicle. Since the technique of Patent Reference-1 performs feedforward control, it needs a reference signal. However, by the feedforward control, it is difficult to obtain sufficient noise reduction effect because correlation between the reference signal and random noise such as road noise is low or it does not meet causality. Therefore, in order to reduce road noise, it is desired to perform a feedback control which does not need a reference signal.

In this respect, since the technique of Patent Reference-2 performs a feedback control, reduction effect of random noise is high. However, since the device of Patent Reference-2 is a closed-type headphone-type device, a user may have an oppressive feeling on ears. Additionally, since the user cannot hear external sound, it does not fit to a use in a vehicle interior.

The above is one of the problems to be solved by the present invention. It is an object of the present invention to provide a non-closed-type active noise control device capable of effectively reducing random noise such as road noise and fits to a use in a vehicle interior.

Means for Solving the Problem

An invention described in claims is an active noise control device formed in a non-closed structure and performing a feedback control, comprising: a noise detection unit configured to detect noise; a correction unit configured to delay a phase of a detected noise signal in a low frequency band; and an output unit configured to output a noise reduction sound which reduces the noise based on the corrected noise signal.

Another invention described in claims is an active noise control method performed by an active noise control device formed in a non-closed structure and performing a feedback control, comprising: a noise detection process to detect noise; a correction process to delay a phase of a detected noise signal in a low frequency band; and an output process to output a noise reduction sound which reduces the noise based on the corrected noise signal.

Another invention described in claims is a program executed by an active noise control device formed in a non-closed structure and performing a feedback control, the program making the computer function as: a noise detection unit configured to detect noise; a correction unit configured to delay a phase of a detected noise signal in a low frequency band; and an output unit configured to output a noise reduction sound which reduces the noise based on the corrected noise signal.

DETAILED DESCRIPTION OF THE PREFERRED EMBODIMENTS

Figure 1A:
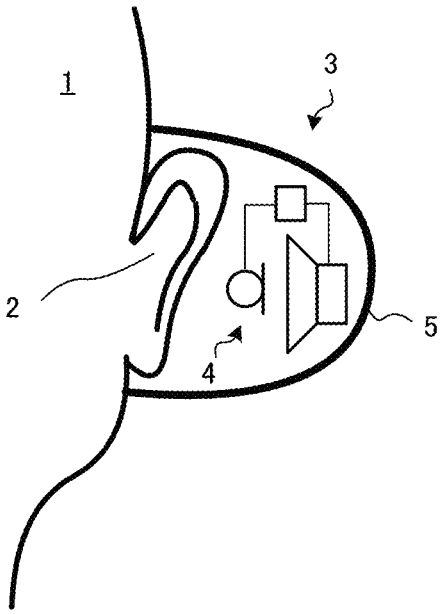
FIG. 1A schematically illustrate a configuration of a closed-type active noise control device, and FIG. 1B schematically illustrates a configuration of a non-closed-type active noise control device.

According to one aspect of the present invention, there is provided an active noise control device formed in a non-closed structure and performing a feedback control, comprising: a noise detection unit configured to detect noise; a correction unit configured to delay a phase of a detected noise signal in a low frequency band; and an output unit configured to output a noise reduction sound which reduces the noise based on the corrected noise signal.

The above active noise control device detects noise, and delays a phase of a detected noise signal in a low frequency band. In a non-closed-type noise control device, since there occurs such a phenomenon that the phase of the noise signal advances in the low frequency band, the correction unit performs a correction to cancel the phase advance by delaying the phase. By outputting the noise reduction sound based on the phase-corrected noise signal, the noise is reduced. In a preferred example, the above active noise control device is installed in a vehicle interior.

In one mode of the above active noise control device, the correction unit uses a filter which delays the phase and increases a gain as a frequency becomes low in the low frequency band. Thus, the phase in the low frequency band can be appropriately corrected.

In another mode of the above active noise control device, the output unit comprises a speaker with a cabinet, and the active noise control device changes the low frequency band, in which the noise is controlled, in accordance with a capacity of the cabinet.

In still another mode, the above active noise control device changes the low frequency band, in which the noise is controlled, in accordance a size or a weight of a diaphragm of the output unit.

In still another mode of the active noise control device, the distance between the detection unit and the output unit is as short as possible. Thus, it is possible to extend the controlled band in which the noise reduction effect can be obtained. Preferably, the distance between the detection unit and the output unit is minimum within a range that the detection unit does not contact the output unit at a time of a maximum magnitude movement of the diaphragm of the output unit.

In still another mode of the above active noise control device, the direction of the detection unit in which a gain of directivity is high is oriented to the output unit. Thus, it is possible to extend the controlled band in which the noise reduction effect can be obtained.

In a preferred example, a pair of the detection unit and the output unit is arranged at a position of each ear of a user.

In still another mode of the active noise control device, the output unit and the detection unit are three-dimensionally arranged at positions in accordance with a state of a listener while maintaining a distance between the output unit and the detection unit. Thus, if the position of the active noise control device is changed according to the state of the user, the distance between the output unit and the detection unit can be maintained to keep the noise reduction effect.

In still another mode of the above active noise control device, the detection unit is arranged between the output unit and a protection member. Thus, it can be prevented that the ear of the user directly contacts the detection unit.

Still another mode of the active noise control device is formed in a partly-closed structure. Thus, it is possible to suppress the phase advance of the noise signal in the low frequency band, and it is possible to extend the controlled band in which the noise reduction effect can be obtained.

In another aspect of the present invention, there is provided an active noise control method performed by an active noise control device formed in a non-closed structure and performing a feedback control, comprising: a noise detection process to detect noise; a correction process to delay a phase of a detected noise signal in a low frequency band; and an output process to output a noise reduction sound which reduces the noise based on the corrected noise signal. By this method, the phase advance of the noise signal in the low frequency band, caused by the non-closed structure, is canceled by delaying the phase by the correction unit. Then, the noise is reduced by outputting the noise reduction sound based on the corrected noise signal.

In still another aspect of the present invention, there is provided a program executed by an active noise control device formed in a non-closed structure and performing a feedback control, the program making the computer function as: a noise detection unit configured to detect noise; a correction unit configured to delay a phase of a detected noise signal in a low frequency band; and an output unit configured to output a noise reduction sound which reduces the noise based on the corrected noise signal. By executing this program by the computer, the above active noise control device can be achieved. This program may be handled in a manner stored in a storage medium.

Embodiment

A preferred embodiment of the present invention will be described below with reference to the attached drawings.

[1] Closed-Type and Simple Open-Type Noise Control Devices

FIG. 1A schematically illustrates a configuration of a closed-type active noise control device (hereinafter simply referred to as "noise control device"). The closed-type noise control device 3 includes a headphone-type housing 5, and is mounted to cover an ear 2 of a user 1. The noise control device 3 includes an internal unit 4 such as a speaker, a microphone and a filter unit inside the housing 5. The internal unit 4 is designed to perform a feedback-type active noise control. However, in such a closed-type noise control device 3, since the ear 2 of the user 1 is covered by the housing 5, it does not fit to a use by a driver in a vehicle interior.

Figure 1B:
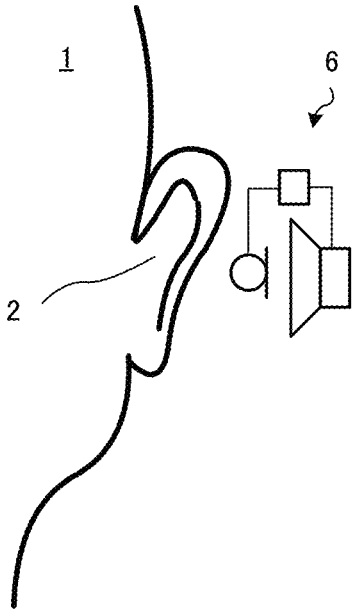

FIG. 1B schematically illustrates a configuration of a non-closed-type (open-type) noise control device. Specifically, a non-closed-type noise control device 6 shown in FIG. 1B is formed only by the internal unit 4 of the closed-type noise control device 3 shown in FIG. 1A by removing the housing 5. In order to distinguish from a non-closed-type noise control device of the embodiment described later, this non-closed-type (open-type) noise control device is referred to as "simple open-type" noise control device 6. Since the simple open-type noise control device 6 does not have a housing to cover the ear 2 of the user 1, the user 1 mounting the device 6 can hear external sound without any difficulty, and it fits to a user in a vehicle interior.

Figure 2A:
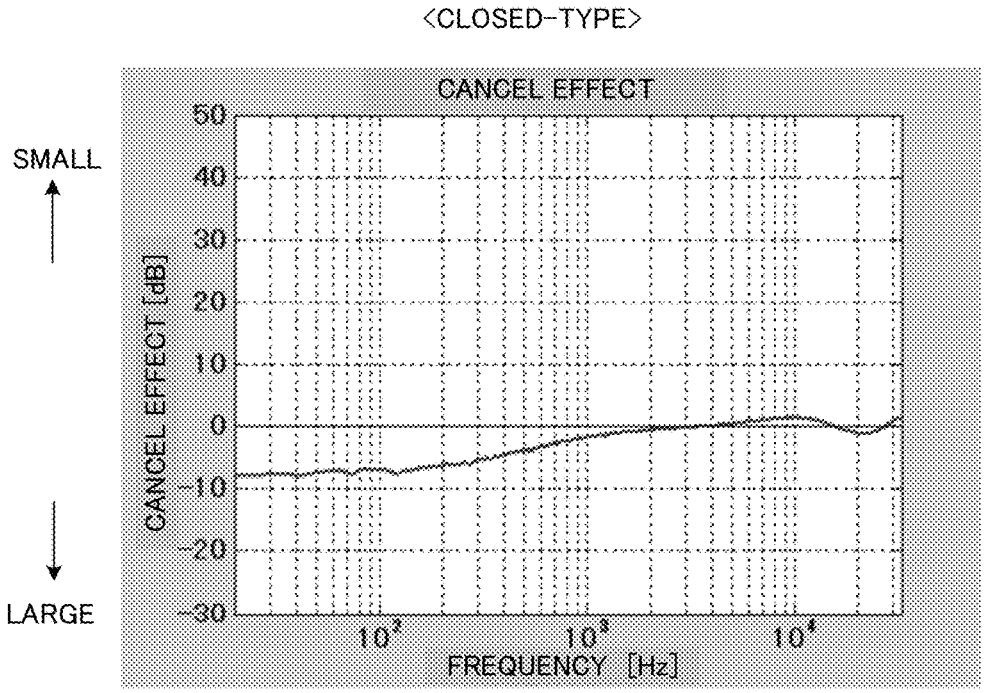
FIG. 2A is a graph showing noise cancel effect by a closed-type noise control device.
Figure 2B:
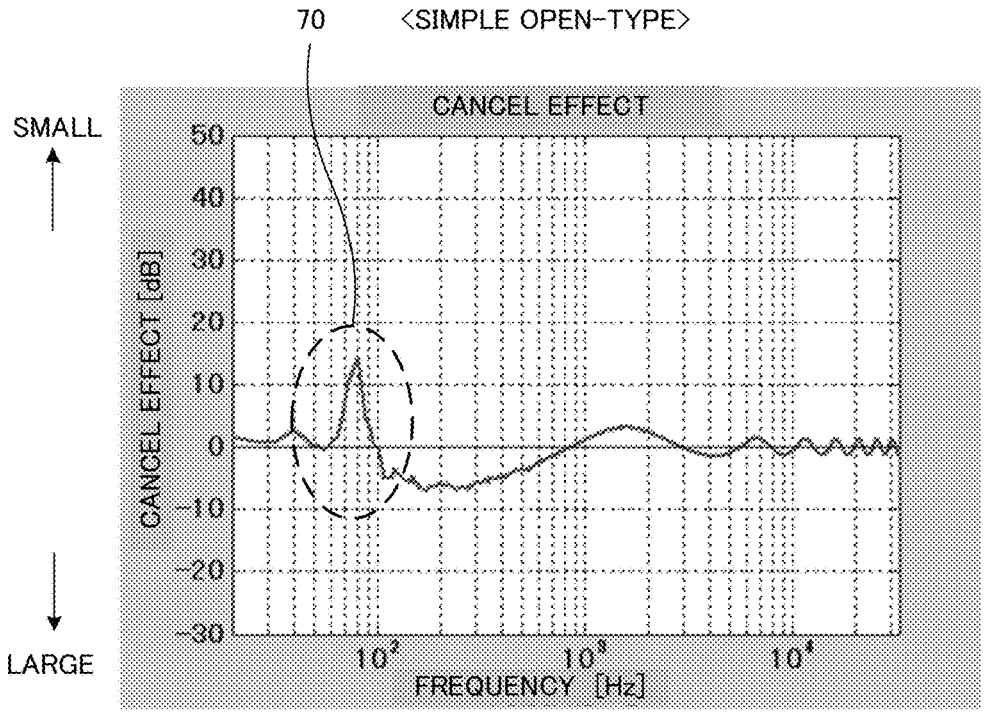
FIG. 2B is a graph showing noise cancel effect by a simple open-type noise control device.

However, when the housing 5 is removed from the closed-type noise control device 3 to form the simple open-type noise control device 6, there always occurs such a problem that the noise reduction effect deteriorates in a low frequency band. FIGS. 2A and 2B are graphs showing noise cancel effect (hereinafter simply referred to as "cancel effect" or "noise reduction effect") by closed-type and simple open-type noise control devices. Specifically, FIG. 2A illustrates the cancel effect by the closed-type noise control device 3 shown in FIG. 1A, and FIG. 2B illustrates the cancel effect by the simple open-type noise control device 6 shown in FIG. 1B. In FIGS. 2A and 2B, the horizontal axis indicates the frequency, and the vertical axis indicates the cancel effect. It is noted that the cancel effect is large as the position in the figure goes down, and is small as the position in the figure goes up. Namely, noise is reduced when the value on the vertical axis is negative, and noise is increased when the value on the vertical axis is positive.

As shown in FIG. 2A, in the closed-type noise control device 3, the noise cancel effect is obtained in an entire frequency band. In contrast, as shown in FIG. 2B, in the simple open-type noise control device 6, the noise cancel effect deteriorates and the noise is increased in the low frequency band shown by the broken line 70. The cause of this will be described below.

Figure 3A:
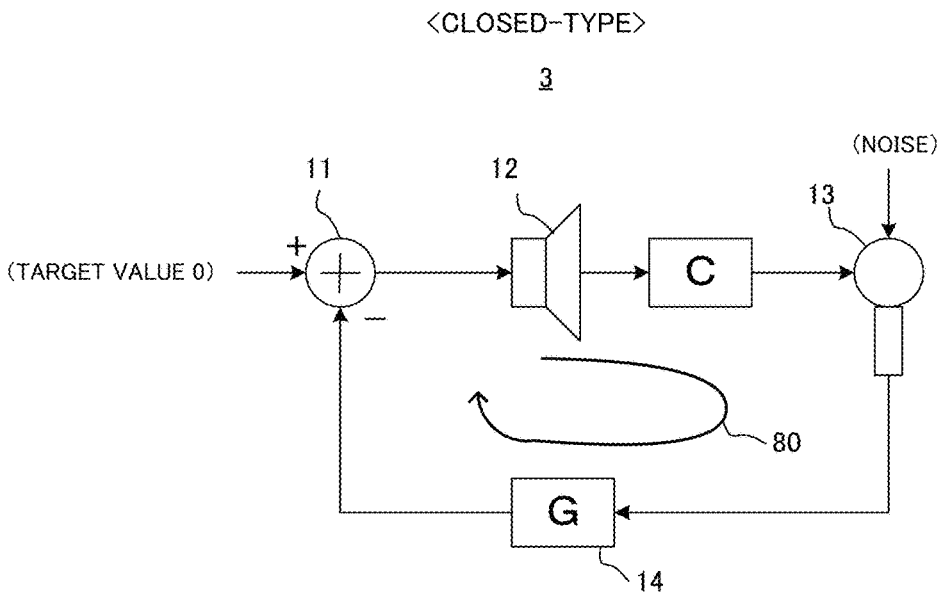
FIG. 3A illustrates a configuration of a closed-type noise control device.

FIG. 3A illustrates a circuit configuration of the closed-type noise control device 3 shown in FIG. 1A. The closed-type noise control device 3 is formed by a feedback circuit including an adder 11, a speaker 12, a microphone 13 and a shelf filter 14. The transfer function from the speaker 12 to the microphone 13 is indicated by "C". Also, the characteristic from the speaker 12 to the microphone 13, indicated by the arrow 80, is called "loop transfer function".

Figure 3B:
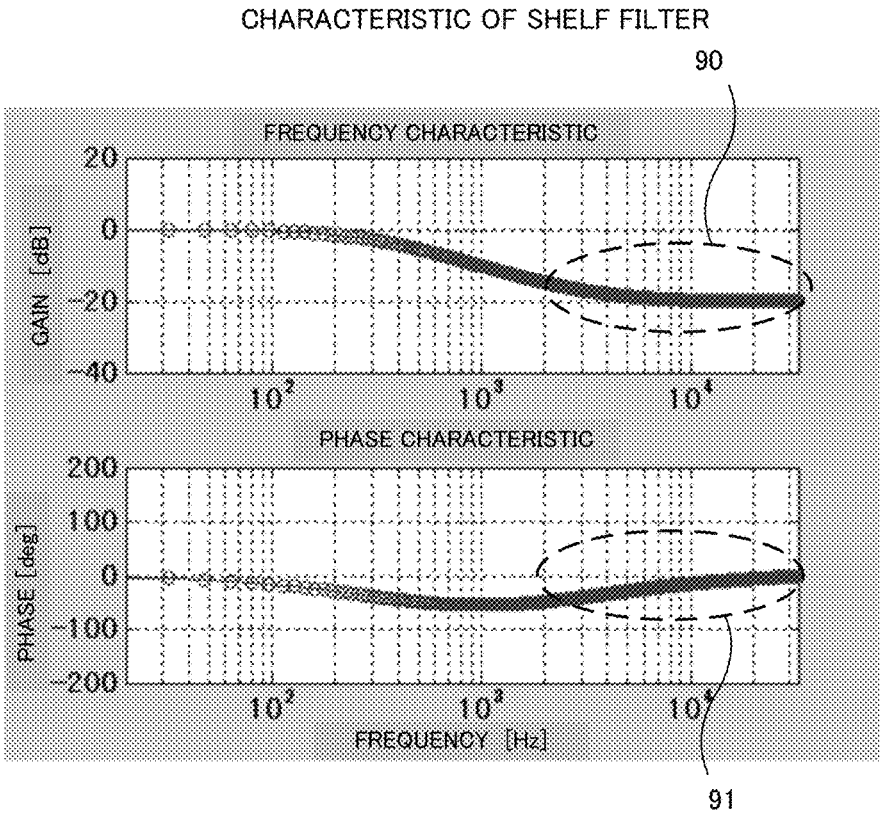
FIG. 3B illustrates characteristics of a shelf filter.

FIG. 3B illustrates a frequency characteristic and a phase characteristic of the shelf filter 14 shown in FIG. 3A. The shelf filter 14 lowers gain (power) in the high frequency band as shown by the broken line 90, and keeps the phase around 0 degree)(° to prevent phase delay.

Figure 4A:
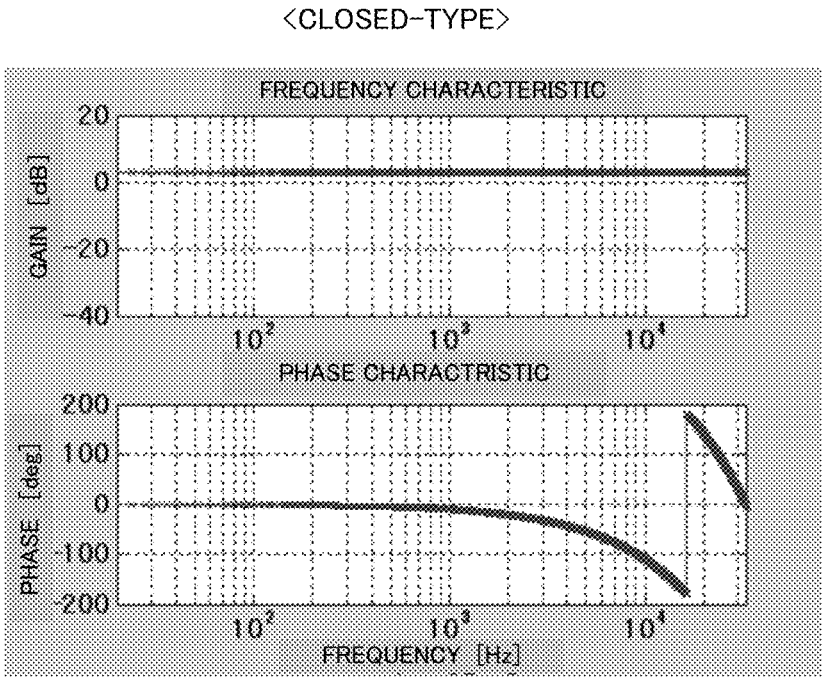
FIG. 4A illustrates characteristics of a closed-type noise control device.

FIG. 4A illustrates a frequency characteristic and a phase characteristic of the closed-type noise control device 3 formed as shown in FIG. 3A. In the case of the closed-type noise control device 3, the frequency characteristic is almost flat, and there is no phase variation from the middle to high frequency band in the phase characteristic. Therefore, desired noise reduction effect can be obtained by the closed-type noise control device 3.

Figure 4B:
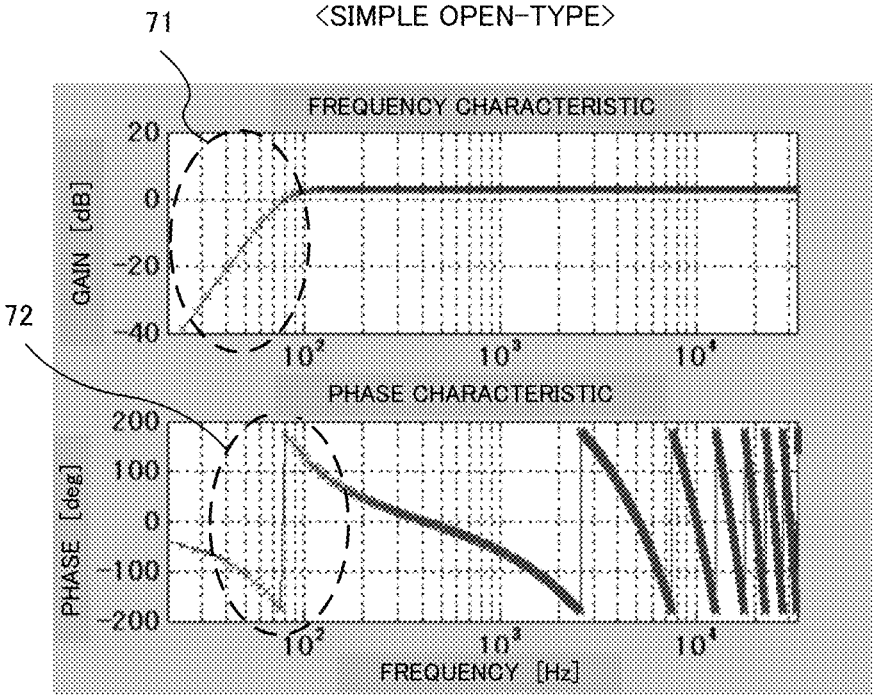
FIG. 4B illustrates characteristics of a simple open-type noise control device.

On the other hand, the simple open-type noise control device is supposed, in which the circuit configuration shown in FIG. 3A is maintained and the housing 5 is removed from the closed-type noise control device 3. A frequency characteristic and a phase characteristic of the simple open-type noise control device 6 are as shown in FIG. 4B. In the simple open-type noise control device 6, gain in the low frequency band lowers as shown by the broken line 71 in FIG. 4B, and the phase advances in the low frequency band as shown by the broken line 72 accordingly. In the simple open-type noise control device 6, this causes deterioration of the cancel effect in the low frequency band as shown in FIG. 2B.

Figure 5:
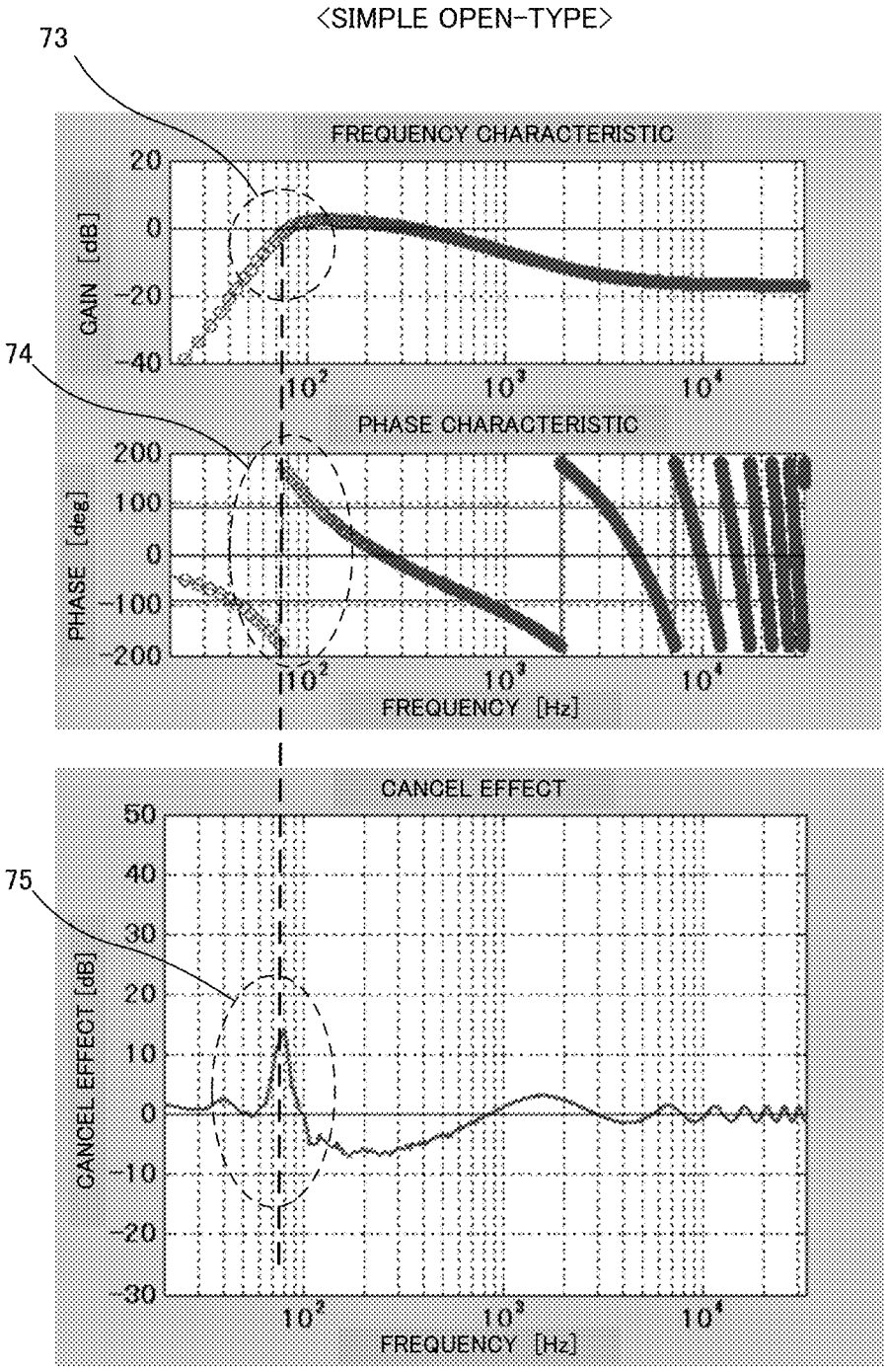
FIG. 5 illustrates characteristics and noise cancel effect of a simple open-type noise control device.

This will be described more specifically. FIG. 5 illustrates a frequency characteristic and a phase characteristic of the loop transfer function as well as the cancel effect of the simple open-type noise control device 6. The loop transfer function is the one shown by the arrow 80 in FIG. 3A. The cancel effect is indicated by sound pressure at the position of the microphone 13.

Based on the feedback control theory, the condition to cancel noise by the feedback circuit shown in FIG. 3A is that the loop transfer function satisfies:

(Condition-1) Phase is within ±90 degrees, and (Condition-2) Gain is large.

If Condition-1 is not satisfied, noise increases. Also, if Condition-1 is not satisfied, the noise increasing amount becomes larger as the gain is larger. Examining this point, in the phase characteristic of the loop transfer function shown in FIG. 5, the phase exceeds ±90 degrees in the low frequency band as shown by the broken line 74. Therefore, Condition-1 is not satisfied, and noise increases. In the frequency characteristic, as shown by the broken line 73, noise increases because Condition-1 is not satisfied and the gain is around 0 dB in the same frequency band, and there occurs a state like an oscillation (If Condition-1 is not satisfied and the gain becomes larger than 0 dB, danger of oscillation becomes high). As a result, as shown by the broken line 75 in the graph of the cancel effect, the cancel effect cannot be obtained in the low frequency band and noise increases about 10 dB.

[2] Non-Closed-Type Noise Control Device of Embodiment (Configuration)

Figure 6:
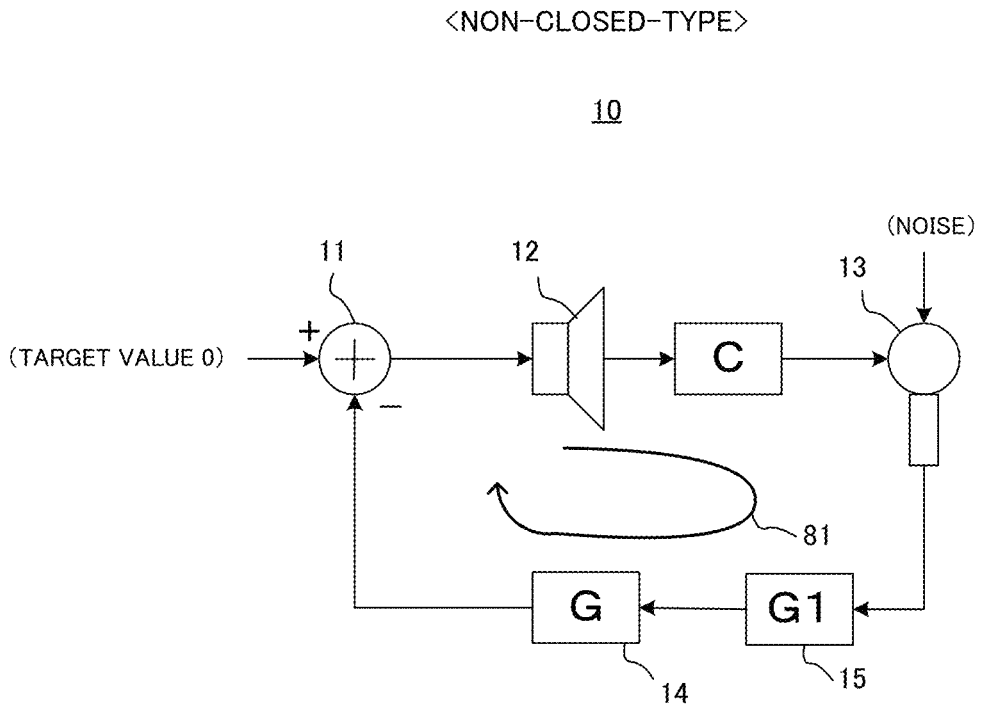
FIG. 6 illustrates a configuration of a non-closed-type noise control device according to an embodiment.

In the above view, in the embodiment, a filter is added to the feedback control circuit so as to prevent deterioration of the cancel effect. FIG. 6 illustrates a configuration of a non-closed-type noise control device 10 according to the embodiment. It is noted that the noise control device 10 will be referred to as "non-closed-type" to be distinguished from the above-described simple open-type noise control device 6.

Figure 7A:
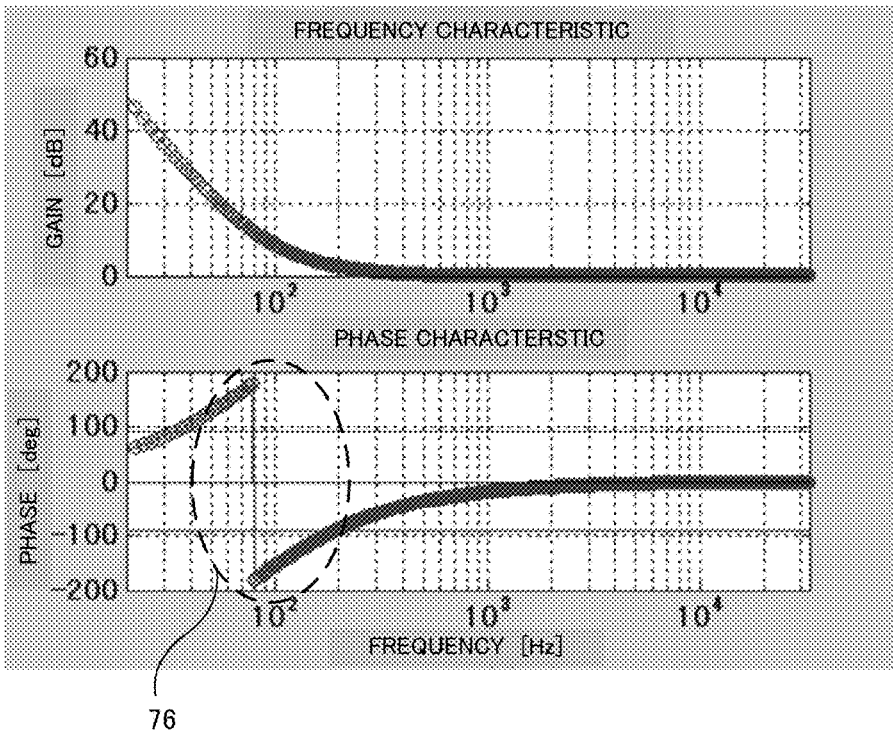
FIGS. 7A and 7B illustrate characteristics of a low boost filter.

In addition to the configuration of the closed-type noise control device 3 shown in FIG. 3A, the non-closed-type noise control device 10 includes a low boost filter 15. FIG. 7A illustrates a frequency characteristic and a phase characteristic of the low boost filter 15. As shown by the frequency characteristic, the low boost filter 15 increases the gain in the low frequency band. More specifically, the low boost filter 15 increases the gain as the frequency becomes low. Also, as shown by the broken line 76 in the phase characteristic, the low boost filter 15 delays the phase. In FIG. 6, the positions of the shelf filter 14 and the low boost filter 15 may be exchanged.

In the above configuration, the speaker 12 is an example of an output unit of the invention, the microphone 13 is an example of a detection unit of the invention, and the low boost filter is an example of a correction unit of the invention.

Figure 8:
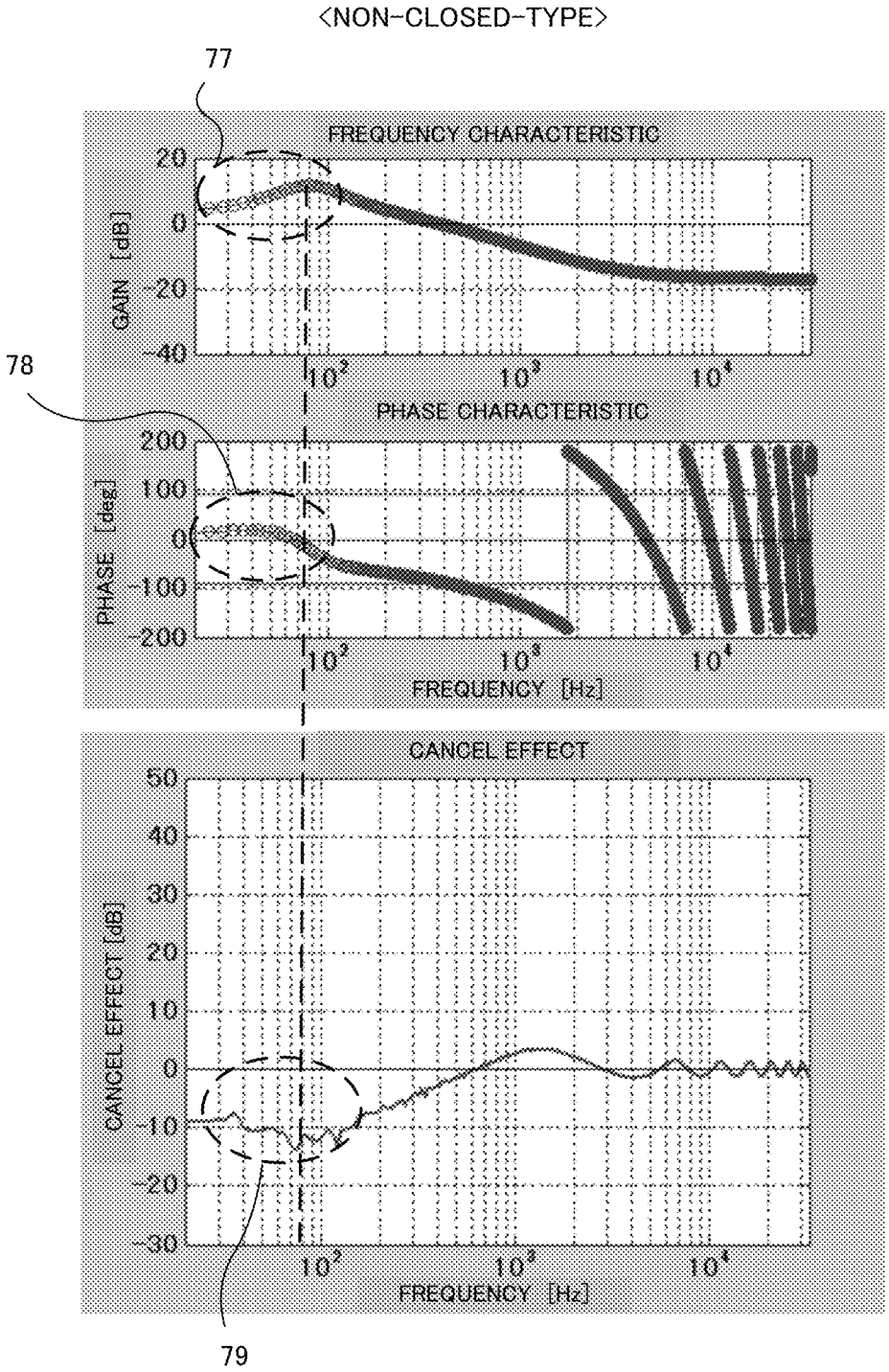
FIG. 8 illustrates characteristics and noise cancel effect of a noise control device according to the embodiment.

FIG. 8 illustrates a frequency characteristic and a phase characteristic of a loop transfer function as well as cancel effect of the non-closed-type noise control device 10. This loop transfer function is the one shown by the arrow 81 in FIG. 6. In the frequency characteristic, as shown by the broken line 77, the gain is increased in the low frequency band to be larger than 0 dB. This is because the low boost filter 15 has the characteristic to increase the gain in the low frequency band as described above. Also, in the phase characteristic, as shown by the broken line 78, the phase is corrected in the low frequency band to be the ideal state of 0 degrees. This is because the low boost filter 15 has the characteristic to delay the phase as described above. Namely, in the characteristics of the simple open-type noise control device 6 shown in FIG. 5, by inserting the low boost filter 15, the gain insufficiency in the low frequency band in the frequency characteristic shown by the broken line 73 is compensated for and the phase advance in the phase characteristic shown by the broken line 74 is canceled by delaying the phase. Thus, by the low boost filter 15, the phase becomes within ±90 degrees and the gain becomes larger than 0 dB, and hence the above-described Condition-1 and Condition-2 are satisfied. As a result, as shown by the broken line 79 in FIG. 8, the cancel effect in the low frequency band can be ensured.

Figure 7B:
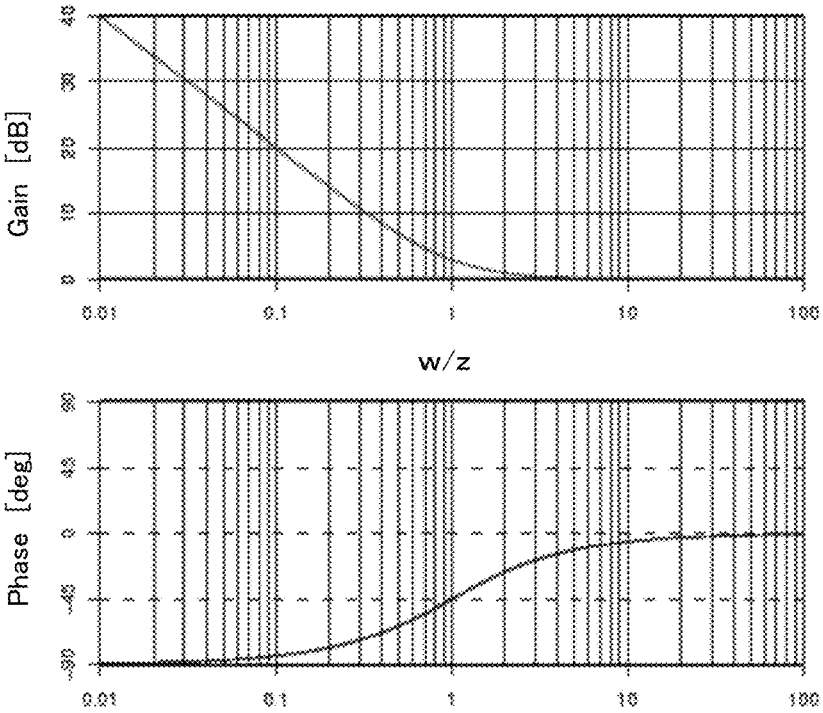

The low boost filter 15 may be designed by serially connecting four primary filters shown in FIG. 7B, for example. In this case, the number of the low boost filter 15 is determined to achieve necessary phase delay for canceling the phase advance generated in the simple open-type noise control device 6.

(Operation)

Figure 9:
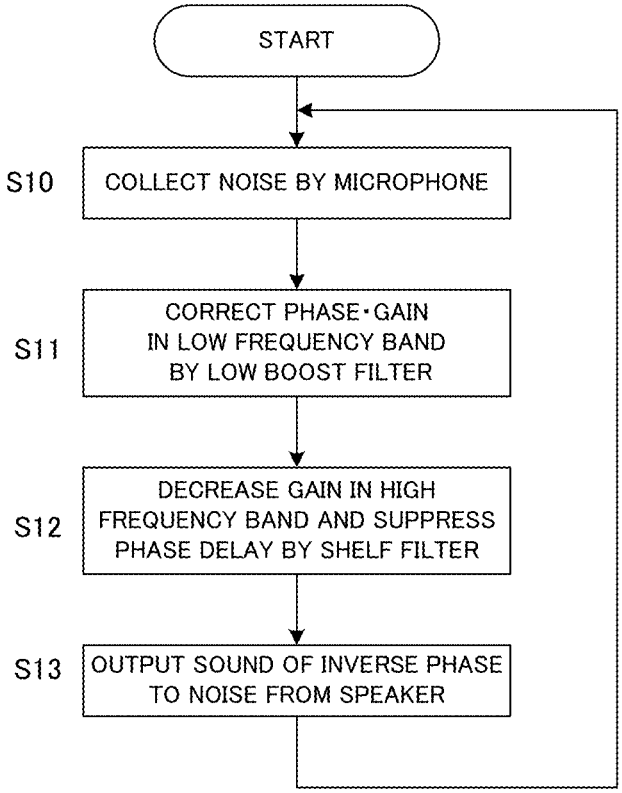
FIG. 9 is a flowchart of noise control processing by the noise control device according to the embodiment.

Next, an operation of the non-closed-type noise control device 10 of the embodiment will be described. FIG. 9 is a flowchart of noise control processing by the noise control device 10. This processing is executed by the constitutive elements of the noise control device 10 shown in FIG. 6.

First, the microphone 13 collects ambient noise (step S10). The collected signal is supplied to the low boost filter 15, and the low boost filter 15 corrects the phase and the gain of the signal in the low frequency band as described above (step S11). Next, the shelf filter 14 suppresses the phase delay while decreasing the gain of the signal in the high frequency band (step S12). The output of the shelf filter 14 is inputted to the adder 11, and the adder 11 operates the difference between the output and the target value 0 to generate the cancel signal having an inverse phase of the noise, and supplies the cancel signal to the speaker 12. Then, the speaker 12 outputs noise reducing sound (also called as "canceling sound") having an inverse phase of the noise. Thus, the noise is canceled.

While FIG. 6 shows the circuit of the noise control device 10 as an analog circuit, it may be designed as a digital circuit. Specifically, an A/D converter is arranged on the output side of the microphone 13, a D/A converter is arranged on the input side of the speaker 12. The adder 11, the shelf filter 14 and the low boost filter 15 are designed as a digital circuit. Also, a part other than the speaker 12 and the microphone 13 may be designed as a computer such as a DSP.

(Noise Cancel Effect)

Figure 10A:
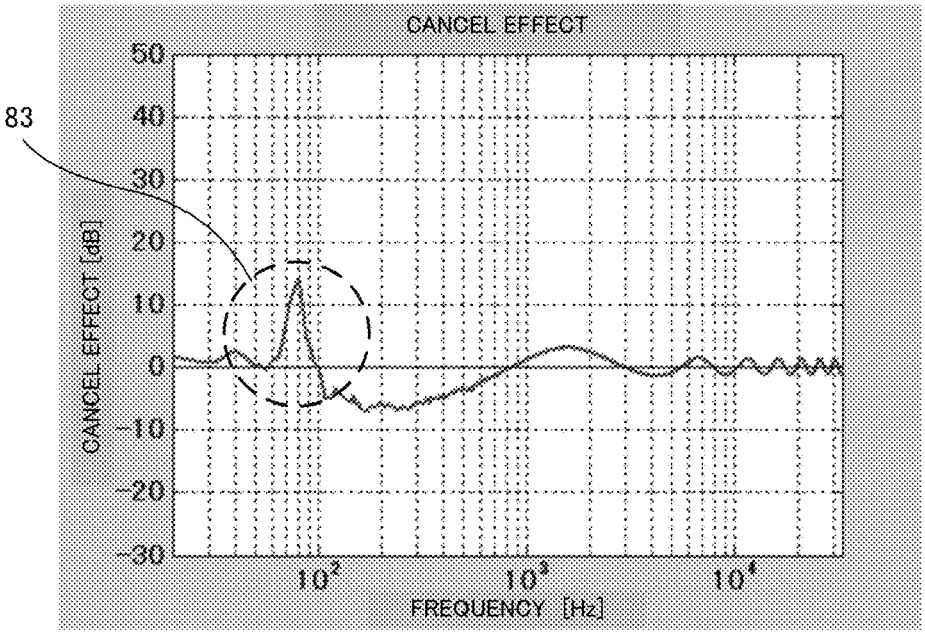
FIG. 10A illustrates noise cancel effect by a simple open-type noise control device.
Figure 10B:
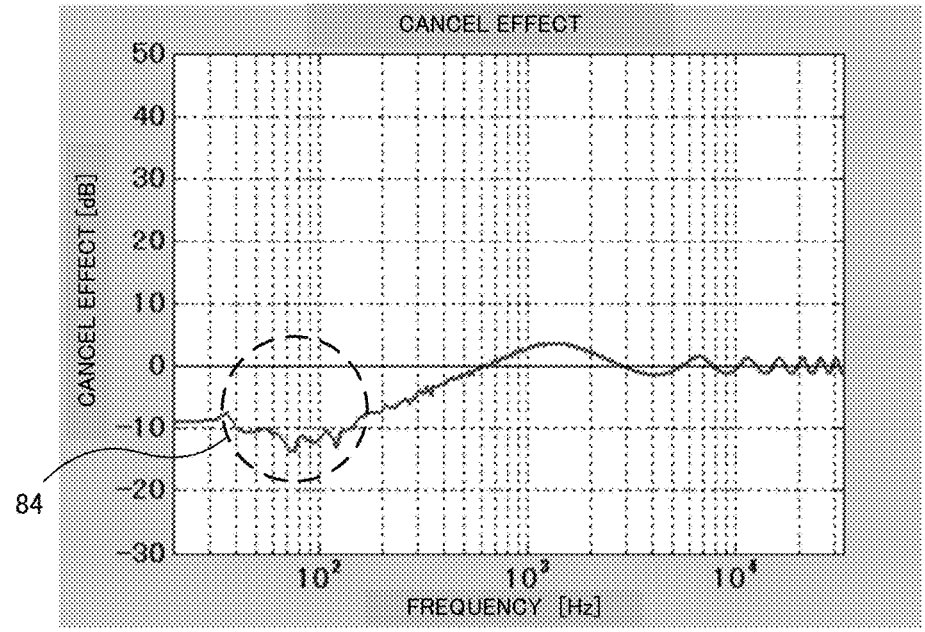
FIG. 10B illustrates noise cancel effect by a non-closed-type noise control device.

FIG. 10A illustrates the cancel effect of the simple open-type noise control device 6 without a low boost filter, and FIG. 10B illustrates the cancel effect of the non-closed-type noise control device 10 with low boost filter. As shown by the broken line 83 in FIG. 10A, if the low boost filter is not provided, the cancel effect deteriorates in the low frequency band and the noise increases. In contrast, as shown by the broken line 84 in FIG. 10B, by providing the low boost filter, the cancel effect in the low frequency band can be ensured.

(Installation Example)

Figure 11:
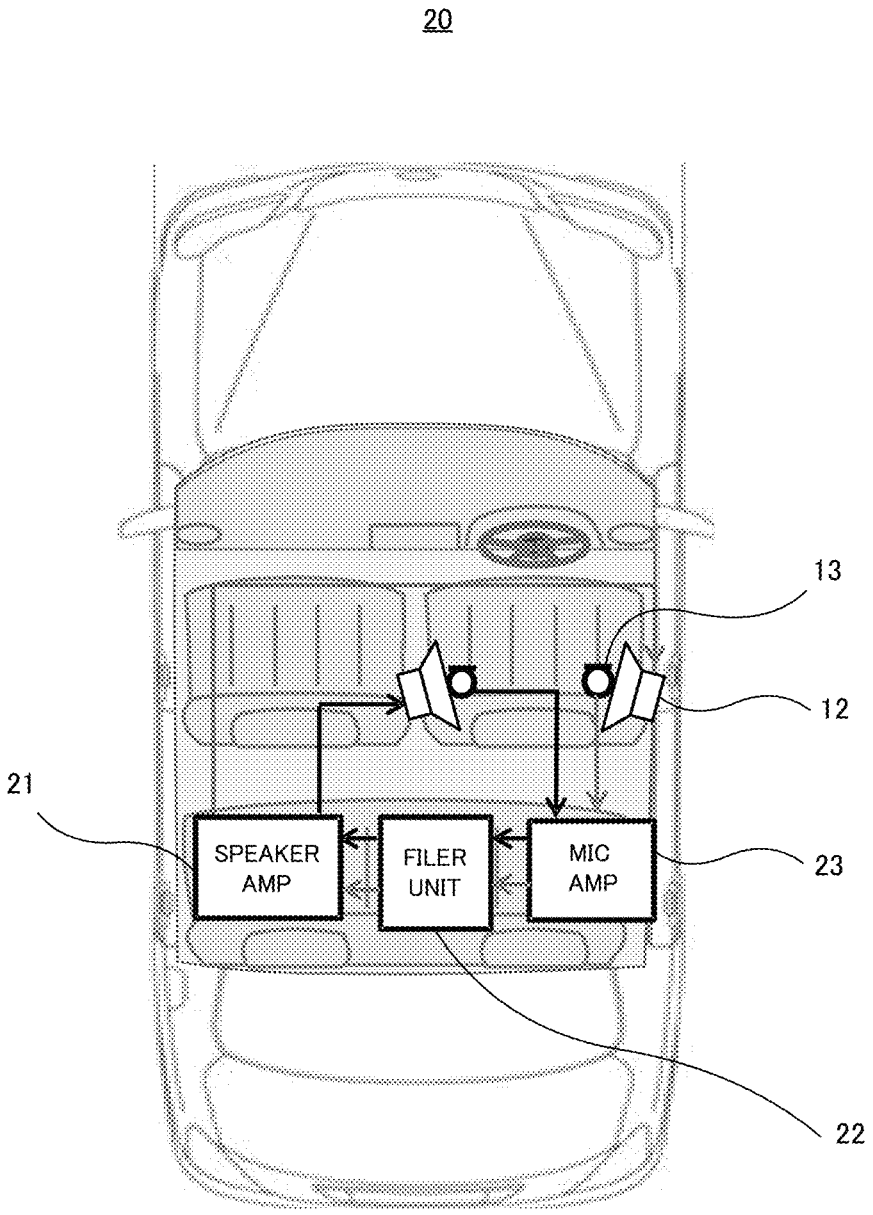
FIG. 11 is a plan view illustrating an example in which the noise control device according to the embodiment is installed in a vehicle.

Next, an installation example of the non-closed-type noise control device 10 of the embodiment will be described. FIG. 11 illustrates an example in which the noise control device 10 is installed in a vehicle 20. In this example, the noise control device 10 is installed on the side of the driver's seat in the vehicle. Specifically, a pair of left and right speakers 12 and a pair of left and right microphones 13 are attached to the driver's seat. For example, the speakers 12 and the microphones 13 are arranged on the left side and the right side of the headrest of the driver's seat. Thus, the speakers 12 and the microphones 13 are positioned near the left and right ears of the user seated on the driver's seat.

Additionally, the noise control device 10 includes a speaker amplifier 21 for amplifying the signal supplied to the speakers 12, a filter unit 22, and a microphone amplifier 23 for amplifying the output signal of the microphones 13. The filter unit 22 includes the shelf filter 14, the low boost filter 15 and the adder 11 included in the feedback circuit shown in FIG. 6.

When the vehicle runs, random noise such as road noise is generated. However, by arranging the non-closed-type noise control device 10 in the vehicle interior in this way, it is possible to cancel the random noise such as road noise at the ears of the driver to make the noise inaudible to the driver.

The speaker 12 is generally designed as a speaker having a cabinet, so-called box-type speaker. In this case, by increasing the volume (capacity) of the cabinet forming the speaker, it is possible to extend the low frequency side of the frequency band (hereinafter referred to as "controlled band") in which the cancel effect is obtained by the noise control device 10. Also, by making the diaphragm of the speaker 12 large or light, the low frequency side of the controlled band can be extended.

Next, the distance between the speaker 12 and the microphone 13 will be described. As the distance between the speaker 12 and the microphone 13 is closer, it is possible to shift the frequency, at which the phase begins to rotate, to the high frequency side in the phase characteristic of the loop transfer function. Therefore, by making the speaker 12 and the microphone 13 as close as possible, the controlled band can be extended to the high frequency side. Actually, since the diaphragm and the microphone cannot contact each other during the operation of the speaker 12, it is desired that the speaker 12 and the microphone 13 are arranged with a minimum distance with which the speaker 12 and microphone 13 do not contact at the time of the maximum magnitude movement of the diaphragm of the speaker 12.

At the time of actual riding, the user adjusts the positions of the seat and the headrest three-dimensionally in front-rear, left-right and up-down directions in accordance with the sitting height and the angle fitting the position of the ear. At that time, it is desired that the position of the noise control device 10 can be three-dimensionally adjusted to the user's state, while maintaining the distance between the speaker 12 and the microphone 13. Namely, it is desired that the speakers 12 and the microphones 13 are attached to the seat or the headrest such that the user can adjust the seat and the headrest three-dimensionally while maintaining the distance between the speaker 12 and the microphone 13.

Figure 12A:
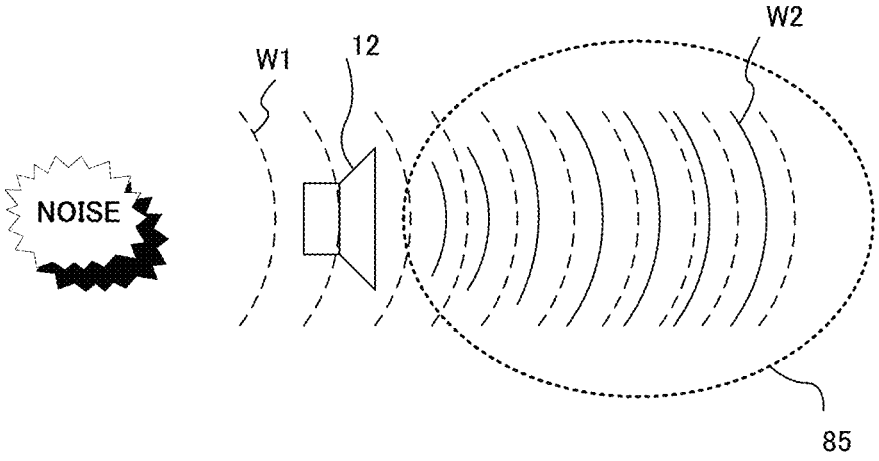
FIGS. 12A and 12B illustrate examples of arranging a speaker and a microphone.

Next, directions of the speakers 12 and the microphones 13 will be described. FIG. 12A illustrates an example of the relation between the noise and the direction of the speaker 12. When the wavefront W1 of noise such as road noise moves as shown in FIG. 12A, the noise is canceled at the area 85 in front of the speaker 12. In this case, when the wavefront W2 of the canceling sound outputted by the speaker 12 coincides with the direction of the wavefront W1 of the noise, the noise reduction control space can be broadened.

Figure 12B:
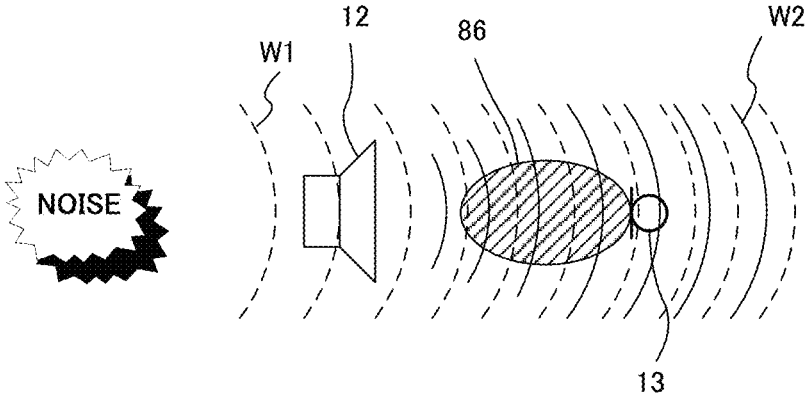

Since a general microphone 13 has a directivity, the speaker 12 and the microphone 13 are relatively arranged such that the high-gain direction 86 of the directivity of the microphone 13 is oriented to the direction of the speaker 12 as shown in FIG. 12B. As a result, the microphone 13 picks up the noise behind the speaker 12 as much as possible, and the noise reduction control space can be broadened.

Figure 13A:
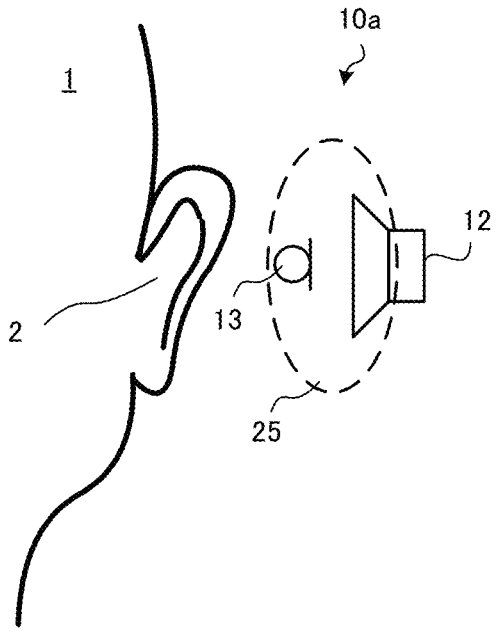
FIGS. 13A and 13B illustrate modified examples of the noise control devices according to the embodiment.

FIG. 13A illustrates a modified example of the noise control device 10, which is a noise control device 10*a* provided with a protection member. Generally, a mesh protection member is provided in front of the speaker 12. In this example, the microphone 13 is arranged between the speaker 12 and the mesh protection member 25 covering the front side of the diaphragm of the speaker 12. Namely, the speaker 12 and the microphone 13 are arranged inside of the mesh protection member 25. Thus, it can be prevented that the ear of the user directly contacts the microphone 13.

Figure 13B:
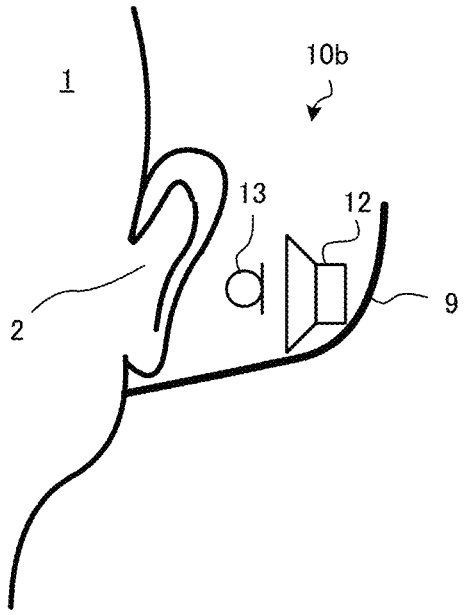

FIG. 13B illustrates another modified example of the noise control device 10, which is a partly-closed-type noise control device 10*b*. In this example, the noise control device 10*b* includes a casing 9 whose upper side is open and in which the speaker 12 and the microphone 13 are received. In the partly-closed-type, in comparison with the simply open-type noise control device 6, the phase advance degree in the low frequency band can be suppressed, and the controlled band can be broadened.

[3] Modified Example

While the non-closed-type noise control device 10 is installed in a vehicle in the above-described embodiment, it can be installed in a movable body such as an airplane and a train instead to reduce ambient noise.

INDUSTRIAL APPLICABILITY

This invention can be used for a device which reduces noise in a movable body.

DESCRIPTION OF REFERENCE NUMBERS

3 Closed-type noise control device
5, 9 Casing
6 Simple open-type noise control device
10 Non-closed-type noise control device
12 Speaker
13 Microphone
14 Shelf filter
15 Low boost filter
21 Speaker amplifier
22 Filter unit
23 Microphone amplifier
25 Protection member

The invention claimed is:

1. An active noise control device formed in a non-closed structure and performing a feedback control, comprising:

a first microphone configured to detect noise and generate a detected noise signal;

low-boost filter connected to a shelf filter, wherein:

when the shelf filter is positioned downstream from the low-boost filter, the low-boost filter is configured to delay the phase of the detected noise signal in a low frequency band and the shelf filter is configured to minimize a change in the phase of the delayed detected noise signal inputted into the shelf filter from the low-boost filter and output a filtered noise signal, and when the shelf filter is positioned upstream from the low-boost filter, the shelf filter is configured to minimize a change in the phase of the detected noise signal and the low-boost filter is configured to delay the phase of the minimized detected noise signal in a low frequency band inputted into the low-boost filter from the shelf filter and output a filtered noise signal; and a first speaker configured to output a noise reduction sound which reduces the noise based on the filtered noise signal.

2. The active noise control device according to claim 1, wherein the active noise control device is installed in a vehicle interior.

3. The active noise control device according to claim 1, wherein low-boost filter uses a filter which delays the phase and increases a gain as a frequency decreases in the low frequency band.

4. The active noise control device according to claim 1, wherein the first speaker comprises a cabinet, and wherein the low frequency band in the active noise device, in which the noise is controlled, is proportional to the volume of the cabinet.

5. The active noise control device according to claim 1, wherein the active noise control device changes the low frequency band, in which the noise is controlled, in accordance with a size or a weight of a diaphragm of the first speaker.

6. The active noise control device according to claim 1, wherein the first microphone and the first speaker are proximal to each other.

7. The active noise control device according to claim 1, wherein the first speaker comprises a diaphragm and wherein the first microphone and the first speaker are proximal to each other and do not contact each other at a time of a maximum magnitude movement of the diaphragm of the first speaker.

8. The active noise control device according to claim 1, wherein the first speaker is arranged in a high-gain direction.

9. The active noise control device according to claim 1, wherein the first microphone and the first speaker are arranged at a position of a first each ear of a user; and a second microphone and a second speaker are arranged at a position of a second ear of the user.

10. The active noise control device according to claim 1, wherein the first speaker and the first microphone are three-dimensionally arranged at positions in accordance with a state of a listener while maintaining a distance between the first speaker and the first microphone.

11. The active noise control device according to claim 1, wherein the shelf filter minimizes the change in the phase other than by minimizing the delay of the phase by the low boost filter.

12. The active noise control device according to claim 1, wherein the change in the phase is other than changing the delay of the phase by the low boost filter.

13. An active noise control method performed by an active noise control device formed in a non-closed structure and performing a feedback control, comprising:

a noise detection process to detect noise and generate a detected noise signal;

a first correction process connected to a second correction process, wherein when the second correction process is positioned downstream from the first correction process, the first correction process is configured to delay the phase of the detected noise signal in a low frequency band and the second correction process is configured to minimize a change in the phase of the delayed detected noise signal inputted into the second correction process from the first correction process and output a corrected noise signal, and when the second correction process is positioned upstream from the first correction process, the second correction process is configured to minimize a change in the phase of the detected noise signal and the first correction process is configured to delay the phase of the minimized detected noise signal in a low frequency band inputted into the first correction process from the second correction process and output a corrected noise signal; and an output process to output a noise reduction sound which reduces the noise based on the corrected noise signal.

14. A non-transitory computer-readable medium storing program executed by an active noise control device formed in a non-closed structure and performing a feedback control, the program causing the computer to function as:

a microphone configured to detect noise and generate a detected noise signal;

low-boost filter connected to a shelf filter, wherein when the shelf filter is positioned downstream from the low-boost filter, the low-boost filter is configured to delay the phase of the detected noise signal in a low frequency band and the shelf filter is configured to minimize a change in the phase of the delayed detected noise signal inputted into the shelf filter from the low-boost filter and output a filtered noise signal, and when the shelf filter is positioned upstream from the low-boost filter, the shelf filter is configured to minimize a change in the phase of the detected noise signal and the low-boost filter is configured to delay the phase of the minimized detected noise signal in a low frequency band inputted into the low-boost filter from the shelf filter and output a filtered noise signal; and a speaker configured to output a noise reduction sound which reduces the noise based on the filtered noise signal.

* * * * *